US005408768A

United States Patent [19]

Karani

[11] Patent Number: 5,408,768

[45] Date of Patent: Apr. 25, 1995

[54] IMPACT HAMMER CYLINDER

[76] Inventor: Ron R. Karani, 33799 S. Woodland, Chagrin Falls, Ohio 44022

[21] Appl. No.: 214,469

[22] Filed: Mar. 18, 1994

[51] Int. Cl.[6] ..... E02F 3/32; E21C 3/04

[52] U.S. Cl. ..... 37/466; 299/37; 173/1; 173/2; 91/173; 172/664; 172/776

[58] Field of Search ..... 60/369; 91/173, 177, 91/508, 511, 514, 218, 516, 179; 92/52, 62, 63, 67; 37/444, 447, 379, 904, 403; 172/40, 54, 664, 663, 776

[56] References Cited

U.S. PATENT DOCUMENTS

| | | | |
|---|---|---|---|
| 3,065,557 | 7/1960 | Pewthers . | |
| 3,363,512 | 1/1968 | Ottestad | 91/5 |
| 3,924,513 | 12/1975 | Ottestad | 91/224 |
| 4,166,410 | 9/1979 | Schlosser | 91/50 |
| 4,258,609 | 3/1981 | Conway | 91/416 |
| 4,351,225 | 9/1982 | Brandenberg et al. | 91/50 |
| 4,411,584 | 10/1983 | Shumaker | 37/379 X |
| 4,506,742 | 3/1985 | Fukase | 173/4 |
| 4,699,223 | 10/1987 | Norén | 175/40 |
| 4,802,538 | 2/1989 | Hays et al. | 173/1 |
| 4,817,733 | 4/1989 | Hennecke et al. | 173/2 |
| 4,834,461 | 5/1989 | Fidler et al. | 299/37 |
| 4,852,663 | 8/1989 | Hunt | 173/134 |
| 4,892,358 | 1/1990 | Ottestad | 299/37 |
| 4,892,359 | 1/1990 | Ottestad | 299/37 |
| 4,900,093 | 2/1990 | Krone et al. | 299/37 |
| 4,959,915 | 10/1990 | Roussin et al. | 37/141 |
| 5,191,825 | 3/1993 | Beneteau et al. | 91/173 |
| 5,205,200 | 4/1993 | Wright | 92/62 X |

*Primary Examiner*—Dennis L. Taylor
*Assistant Examiner*—Robert Pezzuto
*Attorney, Agent, or Firm*—Vickers, Daniels & Young

[57] ABSTRACT

An improved hydraulic cylinder with a hydraulic impact hammer integrated into the cylinder rodhead of the hydraulic cylinder is provided. The hydraulic hammer is positioned inside a central chamber of the cylinder rodhead such that the impact piston can deliver at least one blow along the longitudinal axis of the cylinder rod to create an additive pulse of force.

49 Claims, 8 Drawing Sheets

IMPACT HAMMER CYLINDER

THE FIELD OF THE INVENTION

The present invention pertains to an improved hydraulic cylinder and more particularly to an improved hydraulic cylinder which applies pulses of force upon detection of large loads and can be used on various types of earth moving and demolition equipment.

THE BACKGROUND OF THE INVENTION

The present invention is particularly applicable to hydraulic material handling machinery and it will be discussed with particular reference thereto; however, the invention has much broader applications and can be used with rippers, shears, pile drivers, crushers, etc. Hydraulic cylinders are used on many types of equipment such as front end loaders, backhoe buckets, digging buckets, and various other material handling devices. For each one of these applications, a hydraulic cylinder moves a particular component such as a bucket into position during operation. The size of the equipment is based upon the expected load or force needed to carry out the particular operation. Upon determining the expected load, the size of the equipment can be selected which can operate within the expected load requirements. A typical hydraulic cylinder includes a main cylinder housing having a central cavity and a hole passing through the housing and intersecting the central cavity. Within the central cavity is a cylinder rod having a rodhead section and a rodend section wherein the cross-sectional area of the rodhead section is generally larger than the cross-sectional area of the rodend section. The cylinder rod within the cylinder central cavity is typically moved by hydraulic liquid fluid applied to the base or top of the rodhead. The cylinder rod could also be moved by gases, a mechanical spring or a combination of liquid, gas and/or a mechanical mechanism. The hydraulic cylinder includes a valve system which directs hydraulic fluid within the cylinder central cavity to move the cylinder rod within the cylinder central cavity. The hydraulic cylinder is made of standard materials such as steel, stainless steel or plastic; however, other materials could be used. The type of material and the thickness of the cylinder material determines the maximum pressure rating for a particular hydraulic cylinder. The cylinder housing and central cavity typically have a generally circular cross-sectional area; however, other shapes can be used. The cross-sectional area of the cylinder rod is usually the same cross-sectional shape as the cylinder central cavity to facilitate the movement of the cylinder rod within the cylinder central cavity. The maximum amount of pressure which can be applied to the cylinder rod determines the maximum load the hydraulic cylinder can move during operation. For hydraulic equipment, the load determining factors for a particular piece of equipment is usually based upon the maximum load rating of the hydraulic cylinder and the pressure limit of the seals. The force applied by standard hydraulic cylinders is limited to the strength of the cylinder housing, the size of the cylinder piston and the maximum pressure which can be applied to the cylinder piston. During the operation of a piece of equipment, if the loads encountered by the equipment exceed the maximum load rating of the hydraulic cylinder, the equipment would have to be exchanged for larger equipment or the undersized hydraulic cylinder will be overstressed leading to excessive wear and possible failure. Such situations arise during the excavation of land wherein an unexpected obstacle, such as a layer of rock, is encountered. In the past, a larger piece of equipment would have to be employed to break through the rock layer. In order to avoid the delay necessary to obtain larger equipment, oversized equipment would have to be used. For most of the job, the larger equipment is oversized. Such larger equipment is much more costly to operate and obtain. Furthermore, due to the larger size of the equipment, the equipment is harder to move, maneuver and/or store. As a result, there is a demand for hydraulic equipment which includes a hydraulic cylinder which operates as a standard hydraulic cylinder within expected operation conditions and can supply additional force to overcome unexpected loads which exceed normal operating conditions.

These and other problems are overcome by the present invention wherein a hydraulic cylinder is integrated with a hydraulic impact hammer wherein the impact hammer acts upon the hydraulic cylinder piston when the cylinder piston encounters a load which exceeds normal operating conditions.

THE SUMMARY OF THE INVENTION

In accordance with the present invention, there is provided a hydraulic cylinder mounted on a particular type of earth moving machinery which overcomes the limitations of past hydraulic cylinders by utilizing a novel and vastly improved design.

The improved hydraulic cylinder includes a housing having a central cavity and a hole passing through the housing at a generally right angle to the central cavity and intersecting the central cavity, a cylinder rod positioned in the housing having a longitudinal axis which includes a rodhead and rodend, wherein the rodend passes through the housing hole and the rodhead includes a central chamber, a cylinder rod movement means or a mechanism for moving the cylinder rod within the housing central cavity and an impact piston positioned inside the cylinder central chamber wherein the piston has a longitudinal axis, a top section having a first piston cross-sectional area, a central tool cross-sectional area, a lower tool portion adapted to deliver impact to the base of the central chamber, and a piston movement means or mechanism for moving the piston within the central chamber along the piston longitudinal axis to deliver at least one blow to the central chamber base.

The cylinder rod movement mechanism or means may include a cylinder valve means for regulating the flow of hydraulic fluid within the housing central cavity to control the position of the cylinder rod. The piston movement means may also include a piston valve means for regulating the flow of hydraulic fluid within the cylinder central chamber to control the position of the impact piston. This cylinder valve means and the piston valve means may be integrated together or may be separate valve systems. A pressure sensor may be integrated with the cylinder valve means and/or the piston valve means to detect the hydraulic fluid pressure within the central cavity of the housing. The pressure sensor may be used to signal the termination of hydraulic fluid into the central cavity of the housing and/or can be used to activate the piston movement means when the detected pressure is at least equal to a predetermined pressure set point.

The improved hydraulic cylinder is designed to apply a force to the cylinder rod when the hydraulic machinery encounters a load exceeding the maximum load rating of the hydraulic cylinder. The force is applied by an impact piston creating a force along the longitudinal axis of the cylinder rod. The force from the impact piston is an additive force, which is combined with the constant force of the hydraulic fluid on the cylinder rod and the added force is used to overcome an encounter force which exceeds the maximum force rating of the hydraulic cylinder. The force applied by the impact hammer can be used to break through or overcome the obstacle without having to obtain larger material handling equipment having a stronger hydraulic cylinder. The added force is applied by the impact piston directly to the cylinder rod and along the longitudinal axis of the cylinder rod. The pressure within the housing central cavity is not increased, thus allowing a greater amount of force to be applied along the longitudinal axis of the cylinder rod than was previously obtainable with a particular size of hydraulic cylinder.

The impact piston can be positioned on the outside or the inside of the cylinder rod. The impact piston can be designed so that the force which moves the impact piston in contact with the cylinder rod can be a compressed gas or liquid or by a mechanical mechanism such as a spring. When the impact piston is positioned inside the cylinder rod, the piston is typically located in the rodhead or in the rodhead and rodend; but could be positioned anywhere in the rod. The chamber in which the impact piston is located is generally cylindrically shape; however, other shapes can be used. In a cylindrical chamber, the piston has a generally circular cross-section. The piston is preferably made of a material which resists wear during operation. The impact piston can also be designed to rotate inside of the piston chamber. The rotatable feature allows for even wear of the impact piston, especially at the impacting end of the piston. A hammer tool may be positioned between the impact piston and rod chamber base. The hammer tool facilitates in uniformly directing the impact force to the cylinder rod. If a hammer tool is used, the hammer tool can be designed to rotate inside the piston chamber to facilitate even wear of the hammer tool. A tool bushing may also be provided to limit the movement of the hammer tool within the piston chamber.

The impact piston is typically designed to apply the additional force only when required. The hydraulic cylinder includes a mechanism for activating and deactivating the impact piston. The mechanism for activating and deactivating the impact piston can be an electronic or a mechanical system to detect some type of condition, such as cylinder rod position, pressure in housing central cavity, a signal from an operator, etc. The mechanism is typically designed so as to activate the impact piston when the pressure inside the housing central cavity reaches or exceeds some pre-determined pressure. The pre-determined pressure is usually below the maximum pressure rating for the cylinder housing.

Further in accordance with an aspect of the invention, the mechanism for activating and deactivating the impact hammer is a pressure detector. The pressure detector detects the pressure of the hydraulic fluid within the housing central cavity and when the pressure exceeds some pre-determined pressure level, the pressure detector allows the impact hammer to be activated. The pressure detector is typically part of a piston valve system which directs fluid into the impact chamber to move the impact hammer into a position to impact the cylinder rod. When the piston is located inside the cylinder rod, the fluid is directed into the piston chamber to begin the upstroke of the impact piston. The source of the pressured fluid which moves the piston can be from the pressurized fluid inside the piston chamber or from some other source. The pressure detector is preferably set with a predetermined pressure setting which is less than or equal to the maximum pressure rating of the cylinder housing. By setting the pressure detector set point at a pressure which is slightly less than the maximum pressure rating of the cylinder, slight pressure increases in the housing central cavity, due to the oscillation of the cylinder rod during the operation of the impact piston, will not damage the hydraulic cylinder housing.

Yet, still a further aspect of the present invention, there is an impact trigger which signals the piston valve system to allow the impact piston to begin its downstroke and impact the cylinder rod. The impact trigger can be an electronic or a mechanical device which can detect the position of the piston or some other measurable attribute of the piston or attribute within the piston chamber.

Still another feature of the present invention, the piston valve system includes a shuttle spool which directs hydraulic fluid into and out of the piston chamber. The shuttle spool can be an electronic or a mechanical device which upon receiving a signal, channels hydraulic fluid into the piston chamber during the upstroke of the impact piston and channels hydraulic fluid out of the piston chamber during the downstroke of the impact piston.

In accordance with still another aspect of the present invention, the piston chamber includes a hardened impact base section designed to resist wear upon repeated impact by the impact piston. The impact base can be designed for removal when the base is worn out.

The primary object of the present invention is to provide an improved hydraulic cylinder which can produce an additional force above the maximum load rating of the hydraulic cylinder housing.

Another object of the present invention is a hydraulic cylinder which produces an additional force when a detected load exceeds the maximum pre-determined load.

Still another object of the present invention is the integrating of a hydraulic hammer in a hydraulic cylinder.

Another object of the present invention is to provide a hydraulic cylinder which can be installed in various types of equipment utilizing hydraulic cylinders.

Still another object of the present invention is the provision of a hydraulic cylinder which is economical to use.

These and other objects and advantages of the invention will become apparent from the following description of the species thereof taken together with the accompanying drawings.

DESCRIPTION OF THE PREFERRED EMBODIMENT

Figure 1:
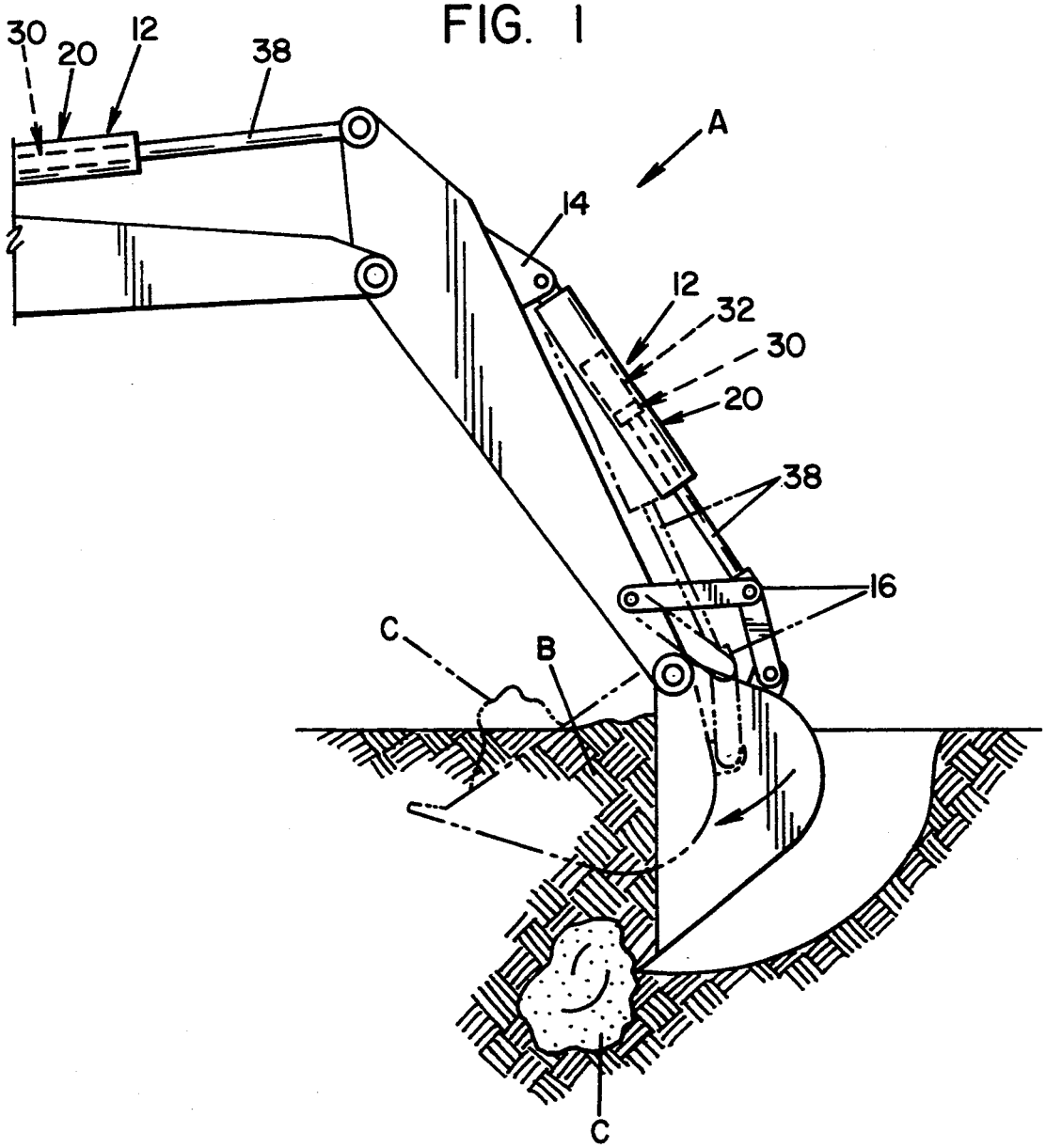
FIG. 1 is an illustration of the present invention in use in combination with a hydraulic shovel.

Referring now to the drawings, wherein the showings are for the purpose of illustrating the preferred embodiments of the invention only and not for the purposes of limiting the same, reference is first made to FIG. 1 which illustrates a heavy duty hydraulic shovel A which incorporates the use of the improved hydraulic cylinder 12. During operation of the shovel A, the hydraulic cylinder 12 is actuated thereby moving the shovel into various positions during operation. Such shovels are widely used in mining and earth moving operations. A mounting 14 and 16 are positioned on the shovel A which provides a point of attachment for the hydraulic cylinder 12 thus allowing the operator to position the hydraulic shovel during operation. During operation, the hydraulic shovel can encounter several types of loads during the digging up of the material B. The force which must be applied by the hydraulic cylinder 12 to overcome these loads can exceed several thousand pounds. The loads can be unexpectedly large when the shovel A encounters unexpected objects, such as the boulder C. Prior to the development of the improved hydraulic cylinder 12, the shovel A, upon encountering a boulder C, would have to be replaced by a shovel having a hydraulic cylinder which could provide a larger force to remove the boulder C.

Figure 2:
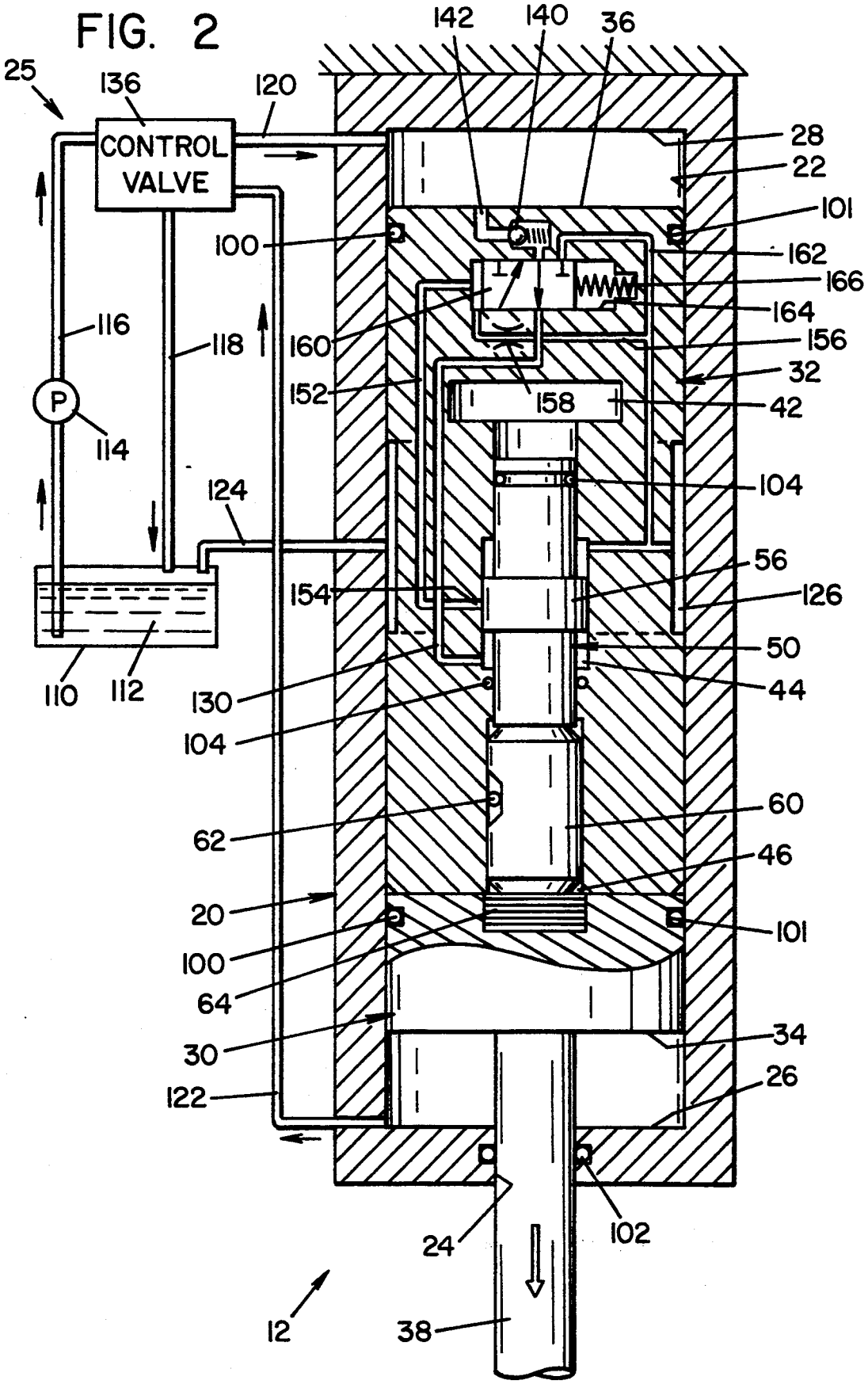
FIG. 2 is a cross-sectional view of the hydraulic cylinder as defined in the present invention.

FIG. 2 discloses the hydraulic cylinder 12 comprised of a cylinder housing 20, a cylinder rod 30, a hydraulic fluid control system 25 and an impact piston 50 positioned inside the rodhead 32. During normal conditions, the hydraulic cylinder 12 operates as a standard hydraulic cylinder. In particular, the operator actuates a control valve 136 to direct the hydraulic fluid 112 into either the cylinder top fluid line 120 or the cylinder bottom fluid line 122 to move the cylinder rod 30 within the housing central cavity 22. When hydraulic fluid 112 is directed through the top fluid line 120, pressure is applied to the rodhead top 36 thereby forcing the rodhead 32 to move toward the housing cavity base 26 and moving the rodend 38 out of the housing cavity 22 through the housing hole 24. The rodend 38 is connected to the shovel mounting 16 to move the shovel bucket into position. When the rodhead 32 moves toward the cavity base 26, the hydraulic fluid 112, which is located between the rodhead end 34 and the cavity base 26, is removed from the housing central cavity 22 by flowing through the cylinder bottom fluid line 122 through the control valve 136, into the fluid drain line 118 and into the hydraulic fluid reservoir 110. When the rodhead 32 moves toward the housing top cavity 28, the hydraulic fluid 112 between the rodhead top 36 and the top cavity 28 is directed through the cylinder top fluid line 120, through the control valve 136, into the fluid drain line 118 and into the hydraulic fluid reservoir 110.

The hydraulic fluid 112 which enters the housing central cavity 22 is pressurized by the hydraulic fluid pump 114 and is directed through the fluid supply line 116 into the control valve 136 whereby the control valve 136 directs the pressurized hydraulic fluid 112 through either the cylinder top fluid line 120 or the cylinder bottom fluid line 122. By controlling the hydraulic fluid flow into the housing central cavity 22, the rodhead 32 can be controllably positioned within the central cavity 22.

At least one cylinder seal 102 is positioned about the cylinder rodend 38 and adjacent to the housing hole 24 to prevent the hydraulic fluid 112 from escaping through the cylinder hole 24. The rodhead 32 includes a seal cavity 101 extending circumferentially about the rodhead 32 and adjacent to the rodhead top 36 and the rodhead end 34. Inside the seal cavity 101 is positioned the rodhead seal 100 to prevent the hydraulic fluid 112 from flowing between the rodhead top 36 and the rodhead end 34. Any hydraulic fluid which bypasses the rodhead seal 100 is channeled into a fluid accumulation region 126 or into the shuttle drain line 162 which is not shown.

Figure 8:
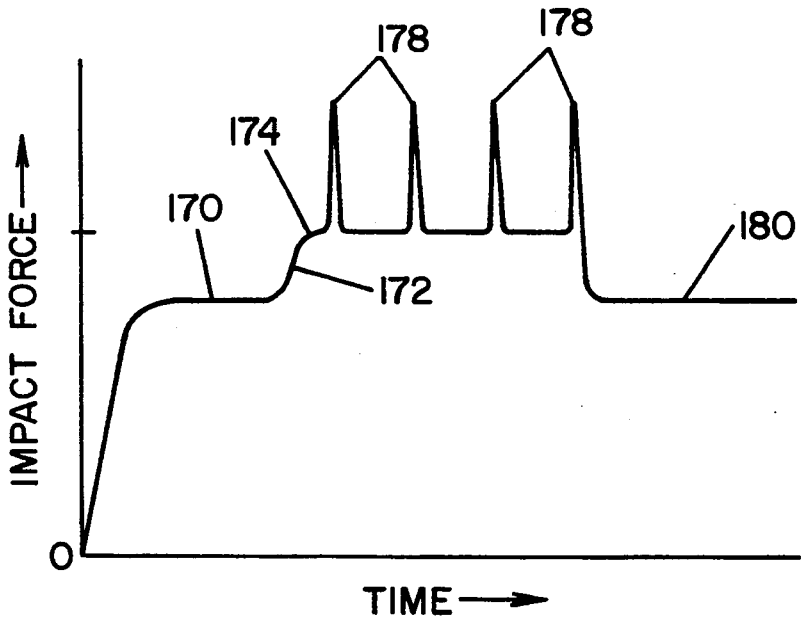
FIG. 8 is a graphical illustration of the force supplied by the hydraulic cylinder during operation.

The above operation has been described when the hydraulic cylinder 12 operates within normal operating parameters. As illustrated in FIG. 1, during operation, an unexpected obstacle C may present itself. In particular, FIG. 1 illustrates the shovel A encountering an obstacle C which requires a much greater force to move than moving the material B. FIG. 8 graphically illustrates the forces the hydraulic cylinder 12 applies during operation. As the shovel A removes the earth material B, the force applied by the hydraulic cylinder 12 is represented by the force represented by the line 170. When the shovel A encounters an obstacle C, the force applied by the hydraulic cylinder 12 increases as represented by the line 172 until the hydraulic cylinder 12 reaches the maximum force level the hydraulic cylinder 12 can apply as represented by the line 174. For standard hydraulic cylinders, the force level 174 represents the maximum force limit of the hydraulic cylinder. This force limit is a result of the pressure limitations of the cylinder housing 20 and/or the seals 100. Every cylinder housing 20 is rated at some maximum pressure that the cylinder housing can handle before the housing becomes susceptible to structural damage.

The improved hydraulic cylinder 12 is designed to overcome the force limits of standard hydraulic cylinders. As illustrated by the force peaks 178 in FIG. 8, the hydraulic cylinder 12 can apply additional force to the cylinder rod 30 to move the obstacle C. The improved hydraulic cylinder is designed to operate as a standard hydraulic cylinder until the force level 174 is reached. When the force level 174 is reached, the maximum allowed pre-determined pressure level exists in the housing central cavity 22. Preferably, the predetermined pressure is less than the maximum pressure the hydraulic cylinder can withstand before structural damage occurs. The hydraulic cylinder 12 is designed such that the control valve 136 does not direct the hydraulic fluid 112 into the main cylinder housing 20 to exceed the pre-determined pressure. Once the pre-determined pressure is reached, the pressure sensor 140 activates the impact hammer 50. The impact hammer 50 impacts the hammer tool 60 to create a pulse of force along the longitudinal axis of the cylinder rod 30 as represented in FIG. 8 as the force peaks 178. The additional force applied by the impact piston 50 overcomes the force level necessary to move the obstacle C. Once the obstacle C is removed, the hydraulic cylinder 12 once again operates at lower force levels as illustrated by the force lines 180 in FIG. 8 and the impact piston 50 is deactivated.

In operation, the impact piston 50 is actuated when the pressure sensor 140 detects a pressure level of the hydraulic fluid 112 on the rodhead top 36 which exceeds a pre-determined valve. When the pressure applied by the hydraulic fluid 112 on the rodhead 36 falls below the pre-determined pressure, the impact hammer 50 is deactivated. The pressure sensor 140 is preferably located in the rodhead 32. The pressure sensor 140 senses the pressure applied to the rodhead top 36 through the pressure sensor tube 142. Once the pressure sensor 140 detects a pressure level which exceeds the pre-determined pressure, the pressure sensor 140 directs hydraulic fluid acting on the rodhead top 36 through a shuttle spool 160 and into the hammer fluid line 130. The hammer fluid line 130 directs hydraulic fluid into the piston chamber 44 to force the impact piston 50 upwardly into the chamber compression area 42. The impact piston includes the piston seals 104 to prevent the hydraulic fluid 112 from entering the chamber compression area 42 or the impact tool area. Once the impact piston 50 reaches a pre-determined height in the piston chamber 44, the pressure of the hydraulic fluid 112 is released and the pressure of the gas in the chamber compression area 42 drives the impact piston 50 downwardly into contact with the hammer tool 60. The impact piston 50 imparts a large force to the hammer tool 60 at the bottom of the downward stroke to force the hammer tool 60 into the chamber base 46. The force applied on the chamber base 46 is translated longitudinally through the cylinder rod 30 to apply the additional force to the shovel 16. The chamber base 46 preferably includes a hammer impact section 64 made of a hardened material to resist undue wear of the impact area. The hammer tool 60 is preferably retained in the tool chamber by a retaining system. Preferably the retaining system includes a hammer bushing 62. The hammer bushing 62 restricts the movement of the hammer tool 60 and allows the hammer tool 60 to rotate. It will be appreciated that the use of the hammer tool 60 is not required in the invention thereby allowing the impact piston 50 to directly impact the chamber base 46. By removing the hammer tool 60, the amount of space required for the operation of the impact piston 50 within the rodhead 32 is reduced and the operation of the hydraulic cylinder 12 is simplified.

Figure 3:
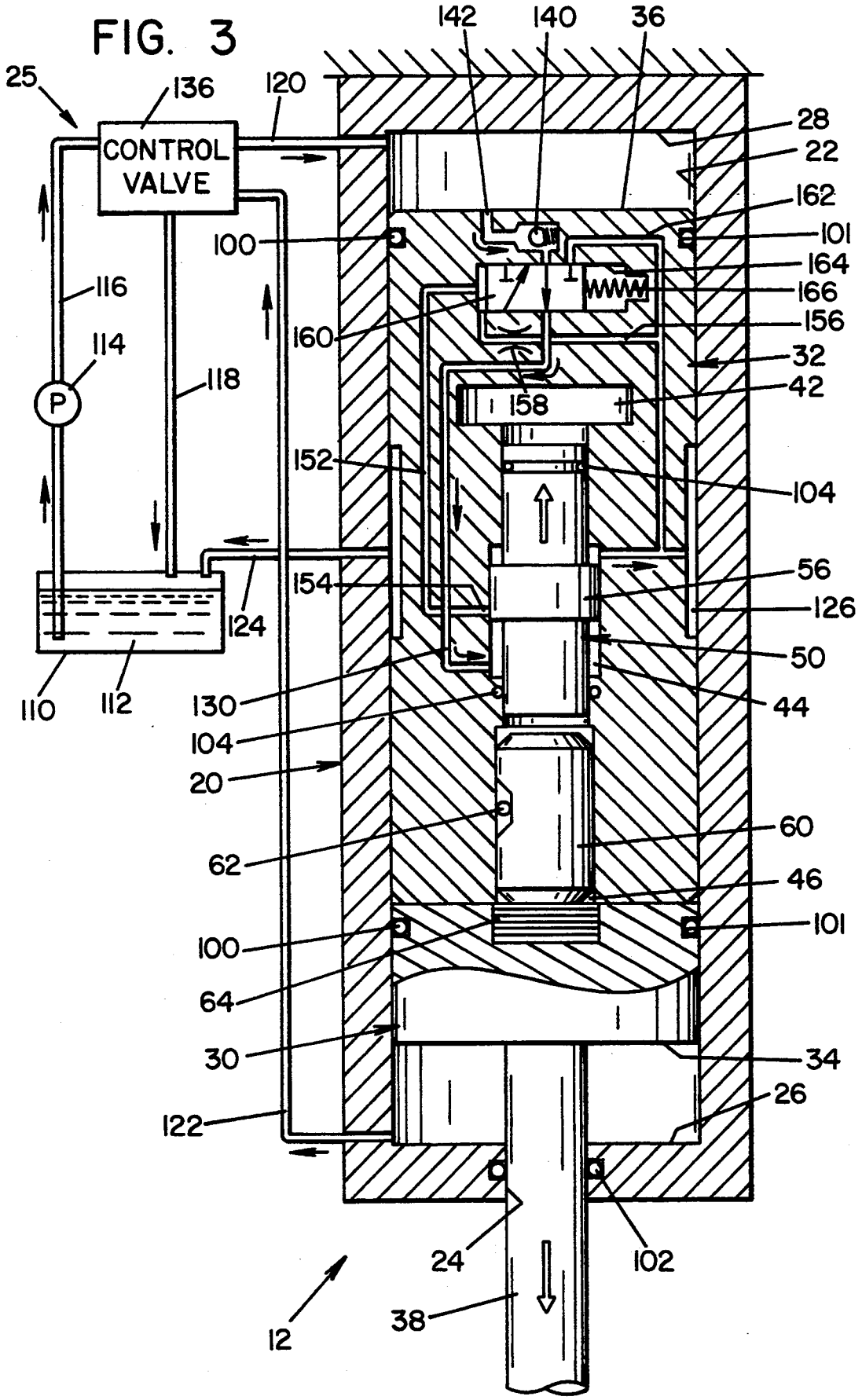
FIG. 3 is a cross-sectional view of the hydraulic cylinder as described in FIG. 2 which further shows the flow of hydraulic fluid within the hydraulic cylinder where the impact piston begins the upstroke.
Figure 4:
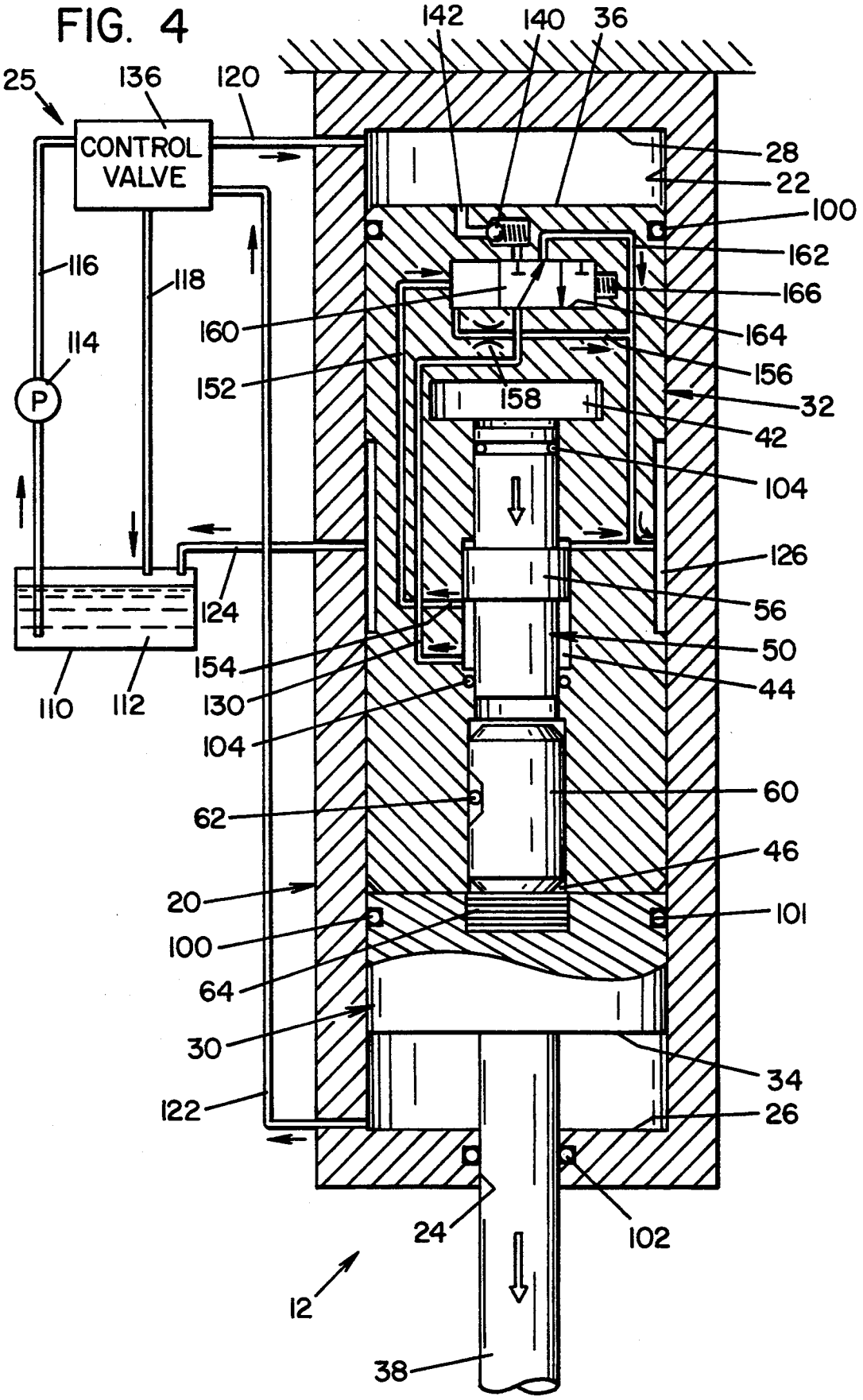
FIG. 4 is a cross-sectional view of the invention as described in FIG. 2 which further illustrates the flow of the hydraulic fluid in the hydraulic cylinder as the impact piston reaches its maximum upstroke position and begins its downstroke.
Figure 5:
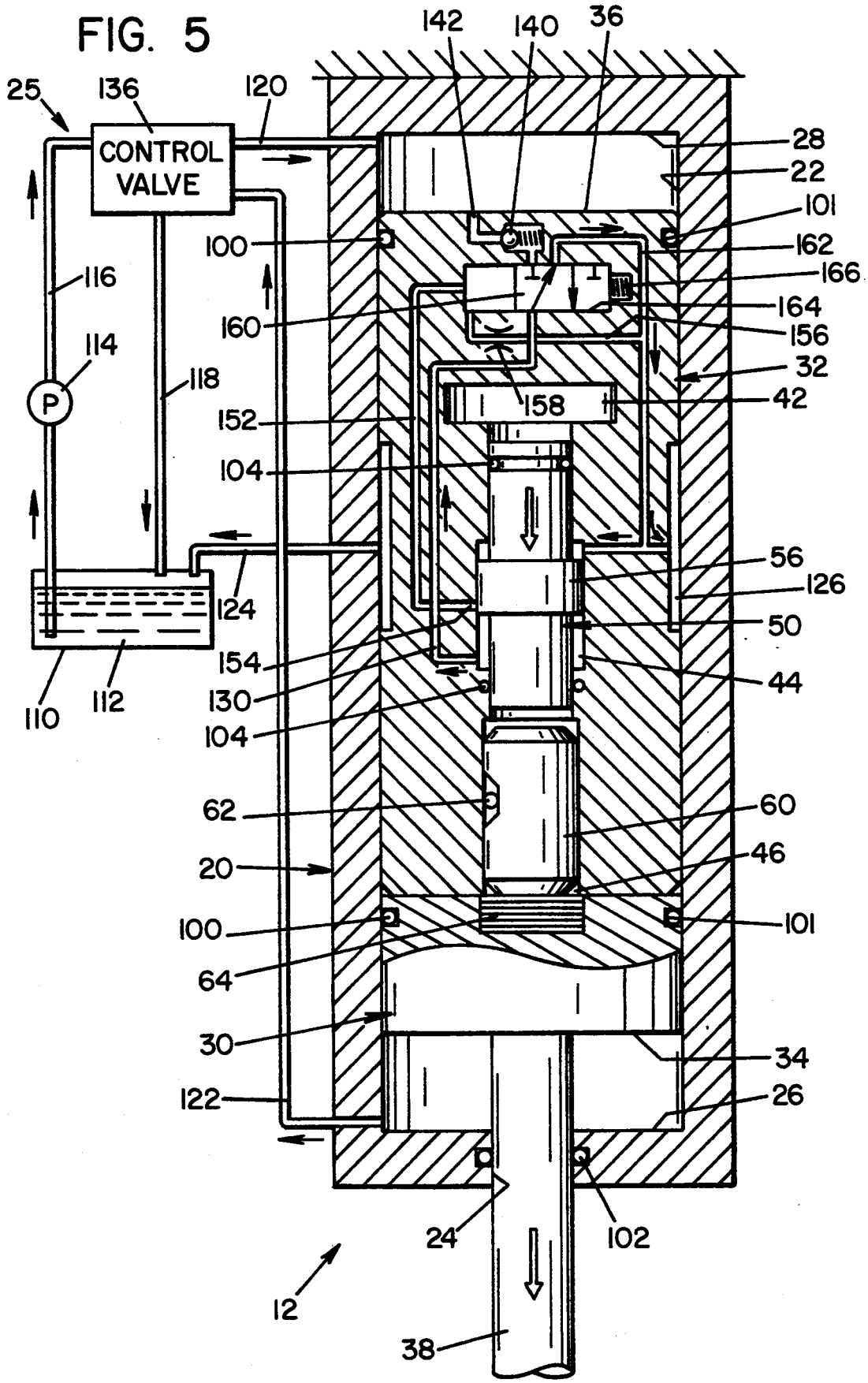
FIG. 5 is a cross-sectional view of the invention as described in FIG. 2 which further illustrates the flow of the hydraulic fluid in the hydraulic cylinder as the impact piston continues its downstroke.
Figure 6:
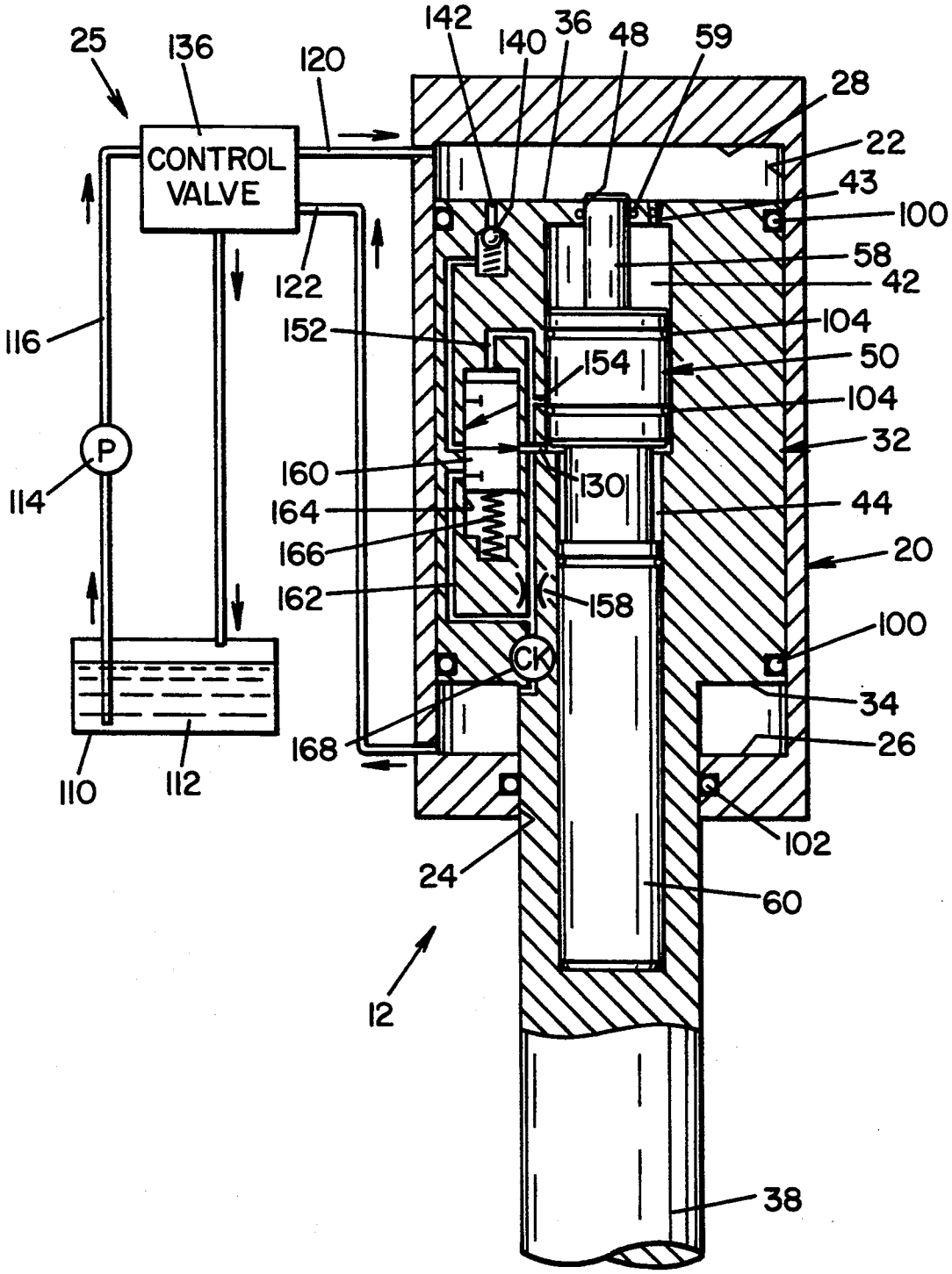
FIG. 6 is a cross-sectional view of an alternate embodiment of the invention as described in FIG. 2.
Figure 7:
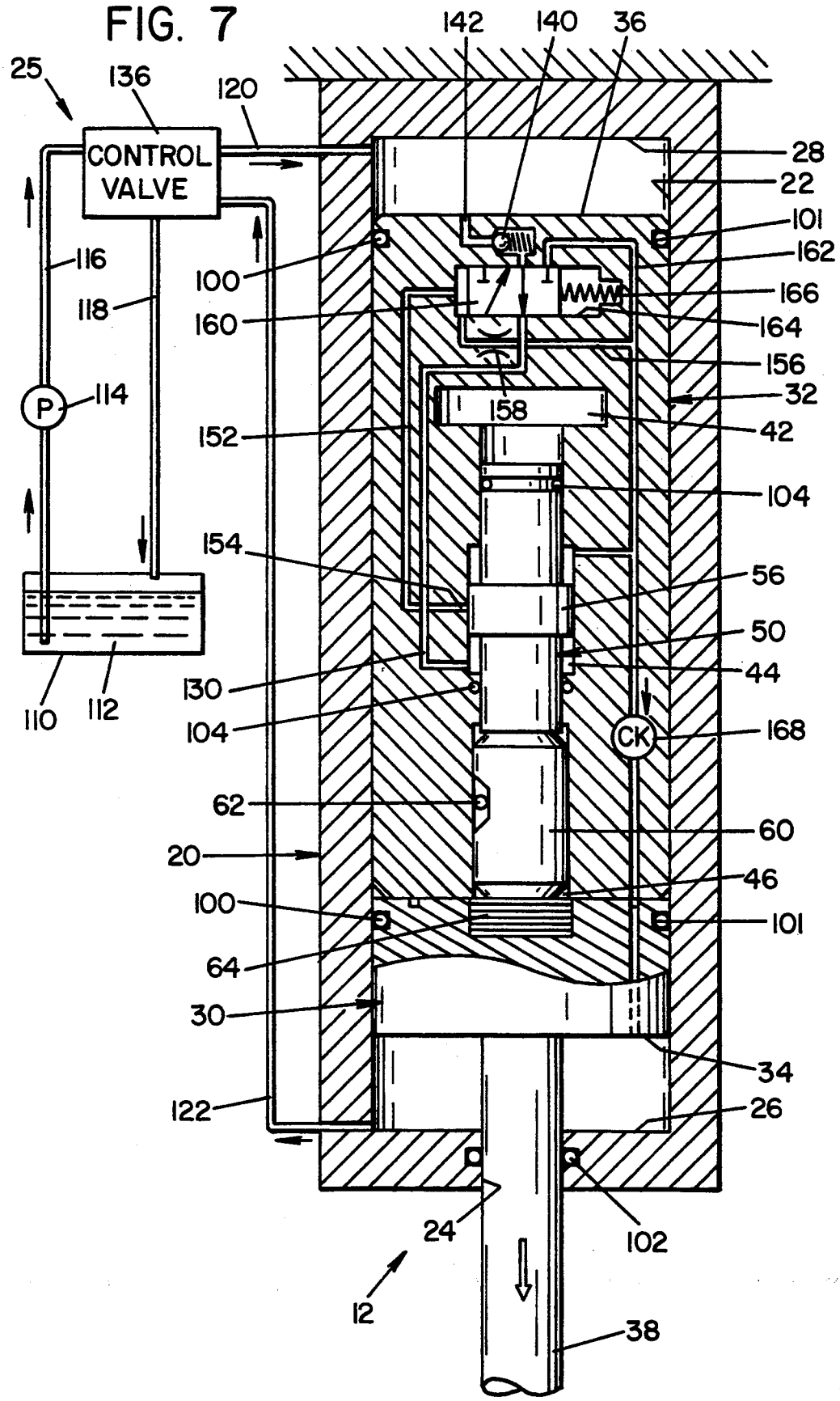
FIG. 7 is a cross-sectional view of an alternate embodiment of the invention as described in FIG. 2.

FIGS. 3–5 show the operation of the impact hammer 50 in the rodhead 32. As stated above, when the pressure sensor 140 detects a pressure acting upon the rodhead top 36 which is equal to or exceeds a pre-determined pressure value, the pressure sensor 140 is actuated to allow the hydraulic fluid 112 to flow through the pressure sensor tube 142 and into the rodhead 32. As the hydraulic fluid 112 flows into the rodhead 32, the pressure applied to the rodhead top 36 is maintained by continuously pumping the hydraulic fluid 112 from the hydraulic fluid reservoir 110 through the control valve 136 and into the cylinder top fluid line 120. As the hydraulic fluid 112 flows through the pressure sensor 140, the hydraulic fluid 112 encounters a valve chamber 164. The valve chamber 164 contains the shuttle spool 160 which directs the hydraulic fluid 112 through various fluid lines during the operation of the impact piston 50. The valve chamber 164 can be a mechanical and/or an electronic device. When the impact piston begins the upstroke cycle and pressurizes the gas in the chamber compression 42, the shuttle spool 160 directs the hydraulic fluid 112 through the hammer fluid line 130. The fluid traveling through the hammer fluid line 130 enters the base of the piston chamber 44 and forces the impact piston 50 toward the chamber compression area 42. As the impact piston 50 travels toward the chamber compression area 42, the gas pressure within the chamber compression area 42 begins to increase. The impact piston 50 continues to move toward the chamber compression area 42 until the trigger detector 154 is activated. The trigger detector 154 may be a mechanical and/or an electronic mechanism. As illustrated in FIGS. 2–7, the trigger detection 154 is preferably an opening on the side of the piston chamber 44 which allows the hydraulic fluid 112 to enter the trigger line 152 when the piston mid-section 56 is raised above the trigger detector 154. When the hydraulic fluid flows into the trigger line 152 and into the valve chamber 164, shuttle spool 160 is re-positioned to prevent the hydraulic fluid 112 from entering the rodhead 32 and channels the hydraulic fluid 112 from the bottom of the piston chamber 44 through the hammer fluid line 130 and into the shuttle drain line 162. The fluid in the shuttle drain line 162 drains into the fluid accumulation region 126 and then channeled to the hydraulic reservoir 110 through the cylinder drain line 124. The fluid accumulation region is formed on the rodhead 32 by creating a cavity on the outer surface of the rodhead 32. This cavity preferably is located around the circumferential surface of the rodhead 32. In an alternative embodiment as illustrated in FIGS. 6–7, the fluid accumulation region 126 is eliminated and the shuttle drain line 162 channels the hydraulic fluid to the rodhead end 34 and into the housing cavity 22. A check valve 168 is preferable positioned on the shuttle drain line 162 near rodhead end 34 to only allow the hydraulic fluid 112 to flow from the valve chamber 164 into the housing cavity 22.

The fluid pressure to move the shuttle spool 160 is maintained for a specified length of time by regulating the flow of the hydraulic fluid 112 out of the valve chamber 164 and the trigger line 152 and into the trigger drain line 156 by the flow regulator 158. The flow regulator 158 can be an orifice or any other flow regulator mechanism. By limiting the flow of the hydraulic fluid 112 through the trigger drain line 156, the pressure applied to the shuttle spool 160 to reposition the shuttle spool and allow fluid to drain from the piston chamber 44 is maintained until the impact piston 50 has completed its downstroke. Once the pressure on the shuttle spool 160 is sufficiently reduced, the valve spring 166 repositions the shuttle spool 160 in the valve chamber 164 to allow the impact piston 50 to begin the upstroke cycle if the pressure sensor 140 detects a sufficiently high pressure.

During the downstroke of the impact piston 50, the hydraulic fluid 112 leaves the piston chamber 44 and the built up pressure in the chamber compression area 42 forces the impact piston 50 down upon the hammer tool 60 thereby creating a pulsed force 178 onto the cylinder rod 30 as illustrated in FIG. 8.

The impact piston 50 continues to operate as long as the pressure sensor 140 detects a pressure acting upon the rodhead top 36 which exceeds a pre-determined pressure. Once the pressure acting upon the rodhead top 36 falls below the predetermined pressure, the pressure sensor 140 closes a valve to prevent, the hydraulic fluid from flowing through the pressure sensor 140 thereby deactivating the impact piston 50. The pressure on the rodhead top 36 decreases when the obstacle is overcome or the operator backs off the controls.

Referring now to FIG. 6, an alternate embodiment of the invention is illustrated where in the impact piston 50 and hammer tool 60 are located in the rodhead 32 and rodend 38. The hammer tool 60 could be eliminated such that impact piston 50 is positioned in rodhead 32 and/or rodend 38. The impact piston 50 as illustrated in FIG. 6 may include a piston accelerator 58 which is connected at the top of the impact piston. The piston accelerator 58 passes through piston chamber hole 48 and into housing central chamber 22. A piston accelerator seal 59 is positioned in piston chamber hole 48 and about the piston accelerator 58 to prevent fluid flow between the compression area 42 and central chamber 22. The high pressure in the central chamber 22 acts on the piston accelerator 58 during the downstroke of impact piston 50 thereby increasing the force of impact of the impact piston 50. The embodiment of FIG. 6 also illustrates a compression area charge hole 43 used to insert a fluid into the compression area 42. The charge hole 43 includes a hole plug to prevent fluid flow between the compression area 42 and central chamber 22.

Modifications and alterations will occur to others upon the reading and understanding of this specification. It is intended that such modifications and alterations be included insofar as they come within the scope of the claims with equivalents thereof.

Having defined the invention, the following is claimed:

1. An improved hydraulic cylinder comprising:

(a) a housing having a central cavity and a hole passing through said housing intersecting said central cavity;

(b) a cylinder positioned in said housing having a longitudinal axis comprising a rod head and a rod end, said rod end passing through said housing hole, said cylinder including a central chamber;

(c) cylinder movement means for moving said cylinder within said housing central cavity; and (d) an impact piston positioned inside said cylinder central chamber, said piston having a longitudinal axis, a top section having a first piston cross sectional area, a central tool cross sectional area, a lower tool portion adapted to deliver impact to the base of said central chamber, and piston movement means for moving said piston within said central chamber along said piston longitudinal axis to deliver at least one blow to the central chamber base.

2. An improved hydraulic cylinder as defined in claim 1, wherein said cylinder movement means includes cylinder valve means for regulating the flow of the hydraulic fluid within said housing central cavity to control the position of said cylinder.

3. An improved hydraulic cylinder as defined in claim 2, wherein said piston movement means includes piston valve means for regulating the flow of hydraulic fluid within said central chamber to control the position of said piston.

4. An improved hydraulic cylinder as defined in claim 3, wherein said piston valve means includes a pressure sensor which detects the hydraulic fluid pressure being applied to said cylinder, said piston movement means moving said piston when said detected pressure is at least equal to a pressure set point.

5. An improved hydraulic cylinder as defined in claim 4, wherein said piston movement means is deactivated when said detected pressure is below said pressure set point.

6. An improved hydraulic cylinder as defined in claim 5, wherein said piston movement means includes trigger detector means for detecting the position of said piston within said central chamber, said trigger detection means creating a signal to allow said piston to deliver at least one blow to said central chamber base when said piston has moved to at least a detector set point.

7. An improved hydraulic cylinder as defined in claim 6, wherein said piston movement means includes a shuttle spool which controls the flow of said hydraulic fluid into said central chamber when said detected pressure is at least equal to said pressure set point.

8. An improved hydraulic cylinder as defined in claim 7, wherein the base of said central chamber includes a hardened impact section to resist wear upon repeated impact.

9. An improved hydraulic cylinder as defined in claim 8, wherein said impact piston is at least partially positioned in said rod head.

10. An improved hydraulic cylinder as defined in claim 1, wherein said piston movement means includes piston valve means for regulating the flow of hydraulic fluid within said central chamber to control the position of said piston.

11. An improved hydraulic cylinder as defined in claim 10, wherein said piston valve means includes a pressure sensor which detects the hydraulic fluid pressure being applied to said cylinder, said piston movement means moving said piston when said detected pressure is at least equal to a pressure set point.

12. An improved hydraulic cylinder as defined in claim 11, wherein said piston movement means terminating said piston movement when said detected pressure is below said pressure set point.

13. An improved hydraulic cylinder as defined in claim 12, wherein said piston movement means includes trigger detector means for detecting the position of said piston within said central chamber, said trigger detection means creating a signal to allow said piston to deliver at least one blow to said central chamber base when said piston has moved to at least a detector set point.

14. An improved hydraulic cylinder as defined in claim 13, wherein said piston movement means includes a shuttle spool which controls the flow of said hydraulic fluid into said central chamber when said detected pressure is at least equal to said pressure set point.

15. An improved hydraulic cylinder as defined in claim 14, wherein the base of said central chamber includes a hardened impact section to resist wear upon repeated impact.

16. An improved hydraulic cylinder as defined in claim 15, wherein said impact piston is at least partially positioned in said rod head.

17. An improved hydraulic cylinder as defined in claim 1, wherein said piston movement means includes trigger detector means for detecting the position of said piston within said central chamber, said trigger detection means creating a signal to allow said piston to deliver at least one blow to said central chamber base when said piston has moved to at least detector set point.

18. An improved hydraulic cylinder as defined in claim 17, wherein the base of said central chamber includes a hardened impact section to resist wear upon repeated impact.

19. An improved hydraulic cylinder as defined in claim 18, wherein a hammer tool is positioned between said impact piston and said central chamber base.

20. An improved hydraulic cylinder as defined in claim 19, wherein said hammer tool is maintained in position by tool retaining means, said tool retaining means comprising of at least one bushing and a pin passing through said bushing and fixing said bushing in place.

21. An improved hydraulic cylinder as defined in claim 1, wherein the base of said central chamber includes a hardened impact section to resist wear upon repeated impact.

22. An improved hydraulic cylinder as defined in claim 1, wherein a hammer tool is positioned between said impact piston and said central chamber base.

23. An improved hydraulic cylinder as defined in claim 22, wherein said hammer tool is maintained in position by tool retaining means, said tool retaining means comprising of at least one bushing and a pin passing through said bushing and fixing said bushing in place.

24. An improved hydraulic cylinder as defined in claim 22, wherein said hammer tool has a circular cross section.

25. An improved hydraulic cylinder as defined in claim 22, wherein said hammer tool being freely rotatable within said central chamber.

26. An improved hydraulic cylinder as defined in claim 23, wherein said hammer tool being freely rotatable within said central chamber.

27. An improved hydraulic cylinder as defined in claim 1, wherein said impact piston is at least partially positioned in said rod head.

28. An improved hydraulic cylinder as defined in claim 1, wherein said cylinder housing has a circular cross section.

29. An improved hydraulic cylinder as defined in claim 28, wherein said hammer tool being freely rotatable within said central chamber.

30. An improved hydraulic cylinder as defined in claim 1, wherein said piston valve means includes a pressure sensor which detects the hydraulic fluid pressure being applied to said cylinder, said piston movement means moving said piston when said detected pressure is at least equal to a pressure set point.

31. An improved hydraulic cylinder as defined in claim 30, wherein said piston movement means terminating said piston movement when said detected pressure is below pressure set point.

32. An improved hydraulic cylinder as defined in claim 31, wherein said piston movement means includes trigger detector means for detecting the position of said piston within said central chamber, said trigger detection means creating a signal to allow said piston to deliver at least one blow to said central chamber base when said piston has moved to at least detector set point.

33. An improved hydraulic cylinder as defined in claim 32 wherein said piston movement means includes a shuttle spool which controls the flow of said hydraulic fluid into said central chamber when said detected pressure is at least equal to said pressure set point.

34. An improved hydraulic cylinder as defined in claim 33, wherein the base of said central chamber includes a hardened impact section to resist wear upon repeated impact.

35. An improved hydraulic cylinder as defined in claim 34 wherein said impact piston is at least partially positioned in said rod head.

36. An improved hydraulic cylinder as defined in claim 35, wherein said impact piston is at least partially positioned in said rod head and said rod end.

37. An improved hydraulic cylinder as defined in claim 1 wherein said piston being freely rotatable within said central chamber.

38. An earth moving machine comprising:

(a) a tractor having a hydraulic power source;

(b) a shank connected to said tractor supporting an implement adapted to move earth; and (c) a hydraulic cylinder mounted to said shank and said implement to position said implement during operation, said hydraulic cylinder including a cylinder housing having a generally cylindrical central cavity and a hole passing through said cylinder housing and intersecting said central cavity; a generally cylindrical cylinder positioned inside said cylinder housing central cavity and having a longitudinal axis and a central chamber; an impact piston having a generally cylindrical shape, a longitudinal axis and positioned inside said cylinder; said impact piston adapted to deliver an impact force to said cylinder, and means for activating said impact piston when the pressure acting upon said cylinder rod exceeds a predetermined pressure.

39. An earth moving machine as defined in claim 38, wherein said means for activating said impact hammer includes piston valve means for regulating the flow of hydraulic fluid inside said cylinder to control the position of said piston.

40. An earth moving machine as defined in claim 38, wherein said means for activating said impact piston includes a pressure sensor which detects the hydraulic fluid pressure being applied to said cylinder, said piston movement means moving said piston when said detected pressure is at least equal to pressure set point.

41. An earth moving machine as defined in claim 40, wherein said piston movement means terminating said piston movement when said detected pressure is below said pressure set point.

42. An earth moving machine as defined in claim 38, wherein said means for activating said impact piston includes a shuttle spool which controls the flow of said hydraulic fluid into said central chamber when said detected pressure is at least equal to pressure set point.

43. An earth moving machine as defined in claim 38, wherein said means for activating said impact piston includes trigger detector means for detecting the position of said piston within said central chamber, said trigger detection means creating a signal to allow said piston to deliver at least one blow to said cylinder when said piston has moved to at least piston set point.

44. An earth moving machine as defined in claim 43, wherein said means activating said impact piston includes means for removing hydraulic fluid from said central chamber into said central cavity.

45. An earth moving machine as defined in claim 38, wherein said means activating said impact piston includes means for removing hydraulic fluid from said central chamber into said central cavity.

46. An improved hydraulic cylinder comprising:

a cylinder housing having a central cavity and a hole passing through said housing and intersecting said central cavity; a cylinder rod having a longitudinal axis and positioned inside said central cavity; and an impact piston positioned inside said housing central cavity to apply an impact force on said cylinder along said rod longitudinal axis.

47. An improved hydraulic cylinder as defined in claim 46, wherein said cylinder comprises a rod head, a rod end and a rod head central chamber.

48. An improved hydraulic cylinder as defined in claim 47, wherein said impact piston is positioned inside said rod head central chamber.

49. An improved hydraulic cylinder as defined in claim 48, including means for activating said impact piston when said pressure in said cylinder central cavity is at least equal to a pre-determined pressure.

* * * * *